US005848980A

United States Patent [19]

Demerais

[11] Patent Number: 5,848,980

[45] Date of Patent: Dec. 15, 1998

[54] HOOP SHAPED MASSAGE APPARATUS

[76] Inventor: Donald A. Demerais, P.O. Box 125, Mabton, Wash. 98935-0125

[21] Appl. No.: 846,148

[22] Filed: Apr. 25, 1997

[51] Int. Cl.[6] ..... A61H 23/02; A61H 1/00

[52] U.S. Cl. ..... 601/46; 601/133; 601/135; 601/71; 601/137

[58] Field of Search ..... 601/133–8, 107, 601/71, 15, 46; 606/204; 15/222; 401/8, 201

[56] References Cited

U.S. PATENT DOCUMENTS

| | | | |
|---|---|---|---|
| 4,718,409 | 1/1988 | Gershov et al. | 601/137 |
| 5,327,886 | 7/1994 | Chiu | 601/15 X |
| 5,386,609 | 2/1995 | Xenos | 15/222 |

*Primary Examiner*—Danton D. DeMille

*Attorney, Agent, or Firm*—Stratton Ballew PLLC

[57] ABSTRACT

A hoop shaped massage apparatus and method is provided, and more particularly a versatile massage apparatus with a hoop shaped handle and a universal bracket for receiving a conventional massage unit. The hand held hoop is preferably attached to a conventional "off the shelf" commercially available vibrator. The hoop is adjustably sized to encircle a person's torso, trunk, shoulders or any other portion of the body. The vibrator is removably attached to the hoop by a bracket that includes a hook and loop fastener strap and tabs to hold the massage unit in place. Additionally, the bracket mounts upon the hoop. The hoop is positioned around a selected body area of a user to conveniently and comfortably apply pressure to the massaged portion of the user's body. The hoop acts as guides and leverage arms, aiding the user in applying massage pressure to the massaged area of the body. The massage unit can be a vibrating massage unit of conventional design, or can be a non-vibrating massage device, or a heat massage device.

4 Claims, 6 Drawing Sheets

HOOP SHAPED MASSAGE APPARATUS

TECHNICAL FIELD

The invention provides a hoop shaped massage apparatus and method, and more particularly a versatile massage apparatus with a hoop shaped handle and a universal bracket for receiving a conventional vibrating massage unit. The method of the invention includes utilizing the hoop shaped handle for leverage in applying pressure to the massaged area of the body.

BACKGROUND OF THE INVENTION

Massage is a well known and widely practiced muscle relaxation technique. Muscles in the neck and back often benefit from massage. However, for personal massage, these areas of the body are not easily reachable. Further, even if one could reach these areas, it would be extremely difficult, if not imposible to apply presure when desired or needed during personal or self-massage. Many devices and tools have been designed to aid in personal massage and muscle therapy. The lower neck and the back spine are typically areas that need forceful massage but are out of reach without some type of aid or device. It is also possible that one can even injure themselves by straining to reach such an area. Therefore, a difficulty is encountered in personal massage when an area of the body requiring massage is not easily reachable by that person.

Several devices exist for aiding a person in applying pressure during the massage of hard to reach areas of their own body. One such device is shown in the U.S. Pat. No. 5,530,983 to Maltese. Maltese '983 shows a generally J-shaped handle for a back-treating appliance, like a brush. The handle is disclosed as being able to receive the brush or a massaging device. Maltese '983 teaches the J-shaped handle to afford the user leverage in applying some force upon the back of the user. The Maltese '983 device fails, however, to provide more leverage than a conventional "back scratcher", or hand held arm extension.

Many modem personal massage devices include a vibrating massage unit. Some of these devices are designed to encase or strap to a part of the body desired to be massaged, thereby enabling a person to massage with greater pressure areas of their body which are difficult to reach. These modem vibrating massage units are typically electrically powered, either by batteries or household electrical current.

An example of such a vibrating massage device with a belt or strap system is disclosed in U.S. Pat. No. 2,688,960, to Fischer et al. The Fischer et al. '960 device includes a vibrator device attached to a belt or strap. The device is described therein as being able to be moved along portions of the user's body. In FIG. 1 of Fischer et al. '960, the device is depicted as held by the ends of the belt strap to achieve a back massage. However, a problem in the design of the belt is encountered with Fischer et al. '960. Though the belt of Fischer et al. '960 is likely adequate to attach the vibrator device to a user, the belt is not designed to allow the user to effectively and comfortably move the device continuously or as desired. Further, the belt buckle of the belt shown in the Fischer et al. '960 patent is inadequate when utilized as a hand-hold as suggested in FIG. 1, therein.

An attempt to solve this hand-hold shortcoming of Fischer et al. '960 is observed in the disclosure of U.S. Pat. No. 3,636,945 to Sato. Sato '945 includes grip members on the free ends of strings at opposite ends of a vibrating main body. By pulling on the grip members of the Sato '945 device, a strong massaging effect is reported to be provided.

The grip members of Sato '945 are an improvement over Fischer et al. '960; however, pulling the grip members can still be awkward and uncomfortable to a user, especially a user with weak, sore or injured arms. A need exists for a personal massage device better able to assist the user when applying pressure to the massaged portion of the user's body.

Another attempt to solve the problem presented by the immobility of the vibrator device on a belt patterned after Fischer et al. '960 is disclosed in U.S. Pat. No. 3,996,929 to Mabuchi. Mabuchi '292 shows a massaging machine that is similar in design to the Fischer et al. '960 device but with a vibrating "mobile vehicle" that can travel along a strap attached to the user's body. The mobility of the Mabuchi '292 massage device is another improvement over Fischer et al. '960. However the Mabuchi '292 device is not "user-friendly". It can pinch the user, or become entangled in clothing or hair when it moves during use. The Mabuchi '292 device also requires a complex mechanism to provide for the movement of the device along the strap. Therefore, a need exists for a personal massage device that provides for movement of the massage device without a complex mechanism.

Removably attaching a personal vibrating massage device to a belt or strap system is a feature included in several existing devices. This feature allows the user the option to utilize the vibrating device with or without attachment to the strap or belt. An example of this feature is disclosed in U.S. Pat. No. 4,697,580 to Terauchi. Terauchi '580 includes a screw engagement of the vibrator device onto a pad incorporated into a strap system. The Terauchi '580 device requires the case of the vibrator to be specifically configured to fit upon and engage with the pad. The strap system of Terauchi '580 could not be utilized by other vibrator configurations. Therefore, an additional need exists for a personal massage device that provides a strap system that can incorporate a variety of massage devices.

Another example of a vibrating massage device that is detachable from a belt is disclosed in U.S. Pat. No. 4,732,140 to Stoffregen. Stoffregen '140 describes a vibrating massage device that includes an elastic belt for holding the device against a human body. Stoffregen '140 includes straps that have a loop and hook connection, specifically the product sold under the trademark "VELCRO", to retain the vibrator within the elastic belt. However, Stoffregen '140 only teaches a VELCRO attachment to an elastic belt and only for the round, palm sized vibrating units disclosed therein.

Currently there exists a wide variety of commercially available hand held personal vibrating massage devices. Many of these commercially available devices could be incorporated into a strap or belt, if a universal attachment system could be devised. Removable attachment would be a desired feature, allowing the device to be employed with a belt or strap, or independently as a hand-held device. An attempt to utilize commercially available vibrating devices in a belt can be observed in U.S. Pat. No. 4,055,169 to Baker et al. Baker et al. '169 discloses a vibrator strap that can accommodate a standard, commercially available vibrator. The Baker et al. '169 device includes a means for securing a standard vibrator onto the strap. However, the only means to attach the vibrator to the strap, as taught by Baker et al. '169, is the attachment of the vibrator to the strap with machine screws. Again, the Baker et al. '169 patent fails to teach a universal mounting incorporated into a strap or belt. A need exists for a massage device with a strapping system that can accommodate various commercially available hand held massage devices.

SUMMARY OF INVENTION

The invention provides a hoop shaped massage apparatus and method, and more particularly a versatile massage apparatus with a hoop shaped handle and a universal bracket for receiving a conventional massage unit. The invention includes a hand held hoop, typically fabricated from tubular metal or plastic, preferably attached to a conventional "off the shelf", commercially available vibrator. The hoop is adjustably sized to encircle a person's torso, trunk, shoulders or any other portion of the body. In the preferred embodiment, the vibrator is removably attached to the hoop by a bracket that includes a hook and loop fastener strap and tabs to hold the massage unit in place. Additionally, the bracket mounts upon the hoop.

To implement the device in a preferred manner, the hoop is positioned around a selected body area of a user. The hoop acts as guides and leverage arms, aiding the user in applying massage pressure to the massaged area of the body.

In the most preferred embodiment, the massage unit comprises a vibrating massage unit of conventional design, but can additionally be a non-vibrating massage device, or a heat massage device. Alternatively, a non-massage device, such as a hair dryer or hot comb, could attach to the bracket.

According to one aspect of the invention, the massage device of the present invention conveniently and comfortably applies pressure to the massaged portion of the user's body.

According to another aspect of the invention, the present invention provides for movement of the massage device without a complex mechanism.

According to yet another aspect of the invention, the present invention provides a strap system for a personal massage device that can incorporate a variety of massage devices.

According to still another aspect of the invention, the present invention provides a strap system for a personal massage device that can incorporate various commercially available hand held massage devices.

DETAILED DESCRIPTION OF SPECIFIC EMBODIMENTS

Figure 1:
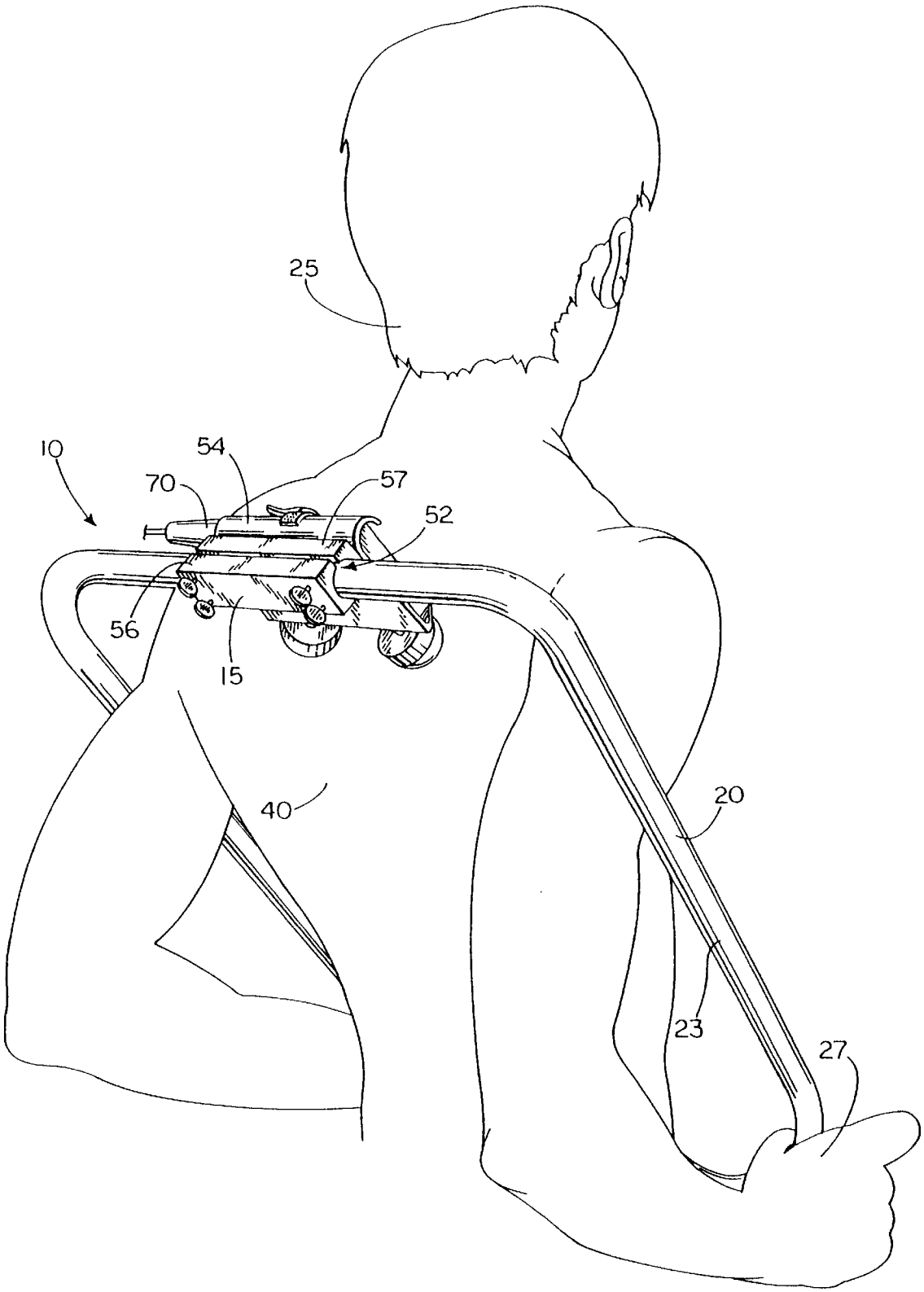
FIG. 1 is a perspective diagram of a hoop shaped massage apparatus, according to an embodiment of this invention, and according to a method of this invention, as implemented by a user.

The invention provides a hoop shaped massage apparatus as illustrated in FIGS. 1 through 7. The massage apparatus 10 includes a bracket 15 and a hand holdable hoop 20 mounted to the bracket. The hand holdable hoop is preferably tubular and fabricated from a conventional plastic pipe or a metal tubing 23. The tubing has a diameter that is selected to enable a user 25 to easily and comfortably grasp the hoop with a hand 27 of the user, as shown in FIG. 1.

Figure 5:
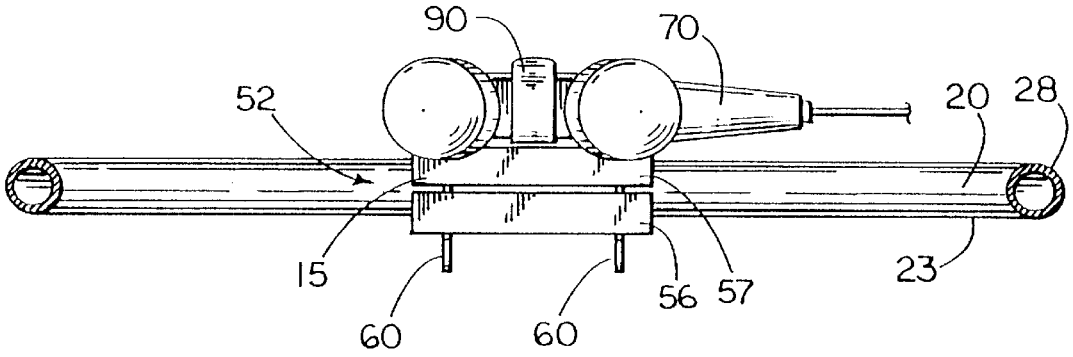
FIG. 5 is an end view of a hoop shaped massage apparatus, according to an embodiment of this invention.
Figure 7:
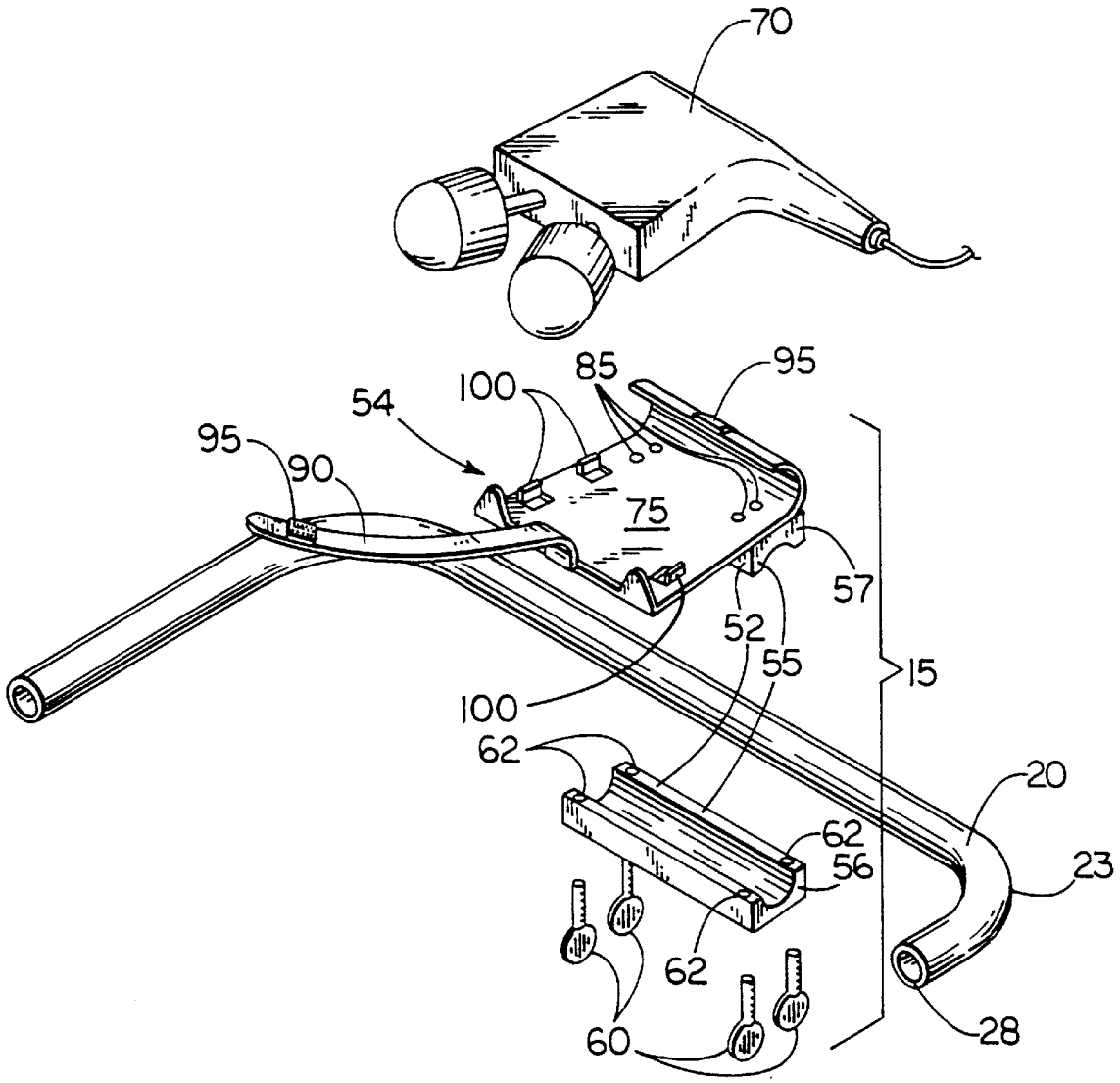
FIG. 7 is a partial, exploded perspective view of a hoop shaped massage apparatus, according to an embodiment of this invention.

The diameter of the tubing 23 utilized for the hand holdable hoop 20 of the massage apparatus 10 is preferably in the range of one to two inches, and most preferably approximately one and one half inches in outside diameter. As shown in FIGS. 5 and 7, the tubing also includes a wall 28 having a thickness selected to impart a substantially rigid shape to the hoop 20, while remaining light in weight, to facilitate easy movement of the hoop by the user 25, shown in FIG. 1. As specifically shown in FIGS. 2 and 3, the hand holdable hoop 20 is preferably generally ovoid in overall shape, but preferably includes a straight upper bar 30 connecting the two legs 32 of a U-shaped lower bar 33, although the inventor also considers square, oval or circular hoops as alternative shapes for additional embodiments of the present invention.

Figure 3:
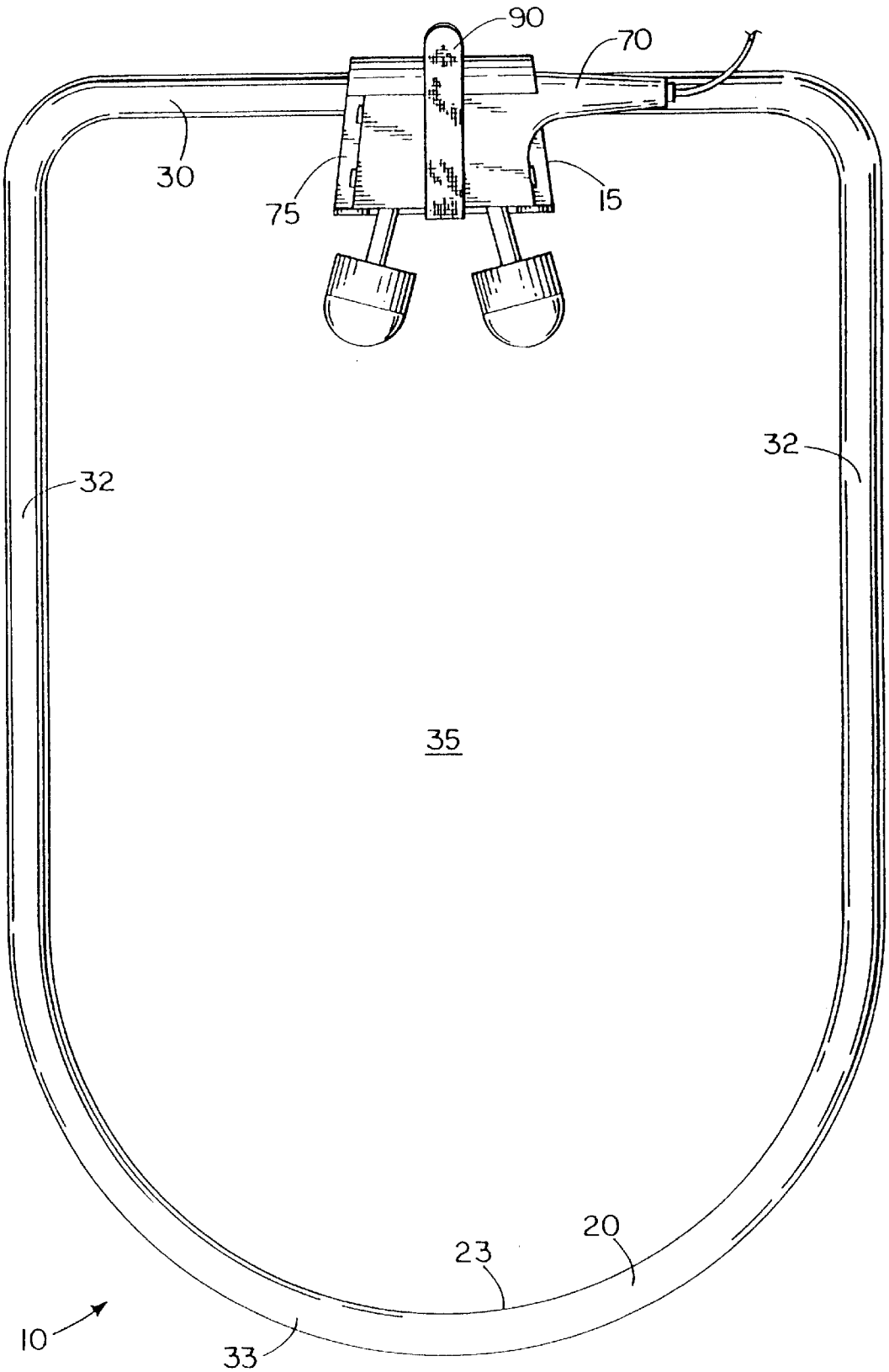
FIG. 3 is an elevational view of a hoop shaped massage apparatus, according to an embodiment of this invention.
Figure 4:
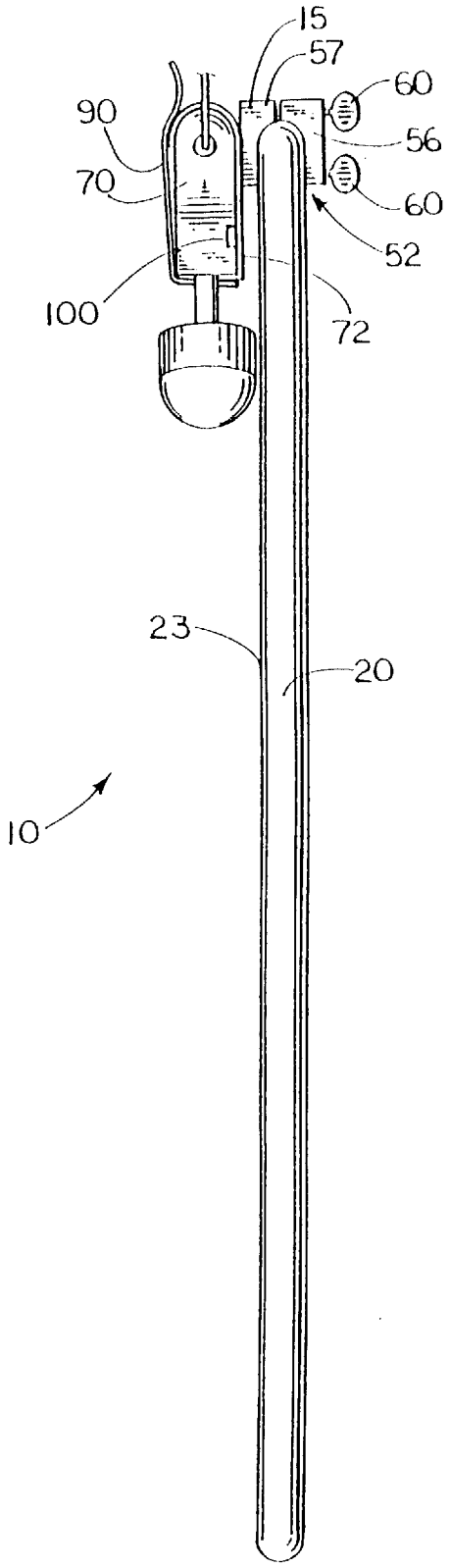
FIG. 4 is a side view of a hoop shaped massage apparatus, according to an embodiment of this invention.
Figure 6:
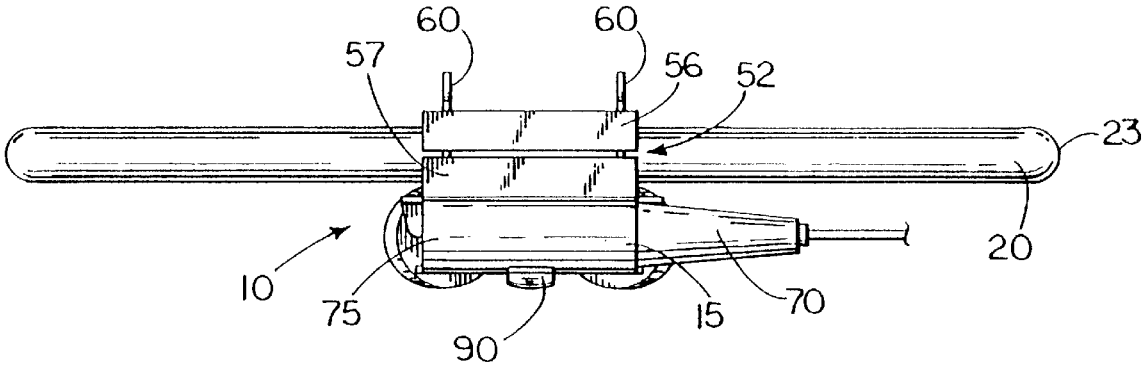
FIG. 6 is an end view of a hoop shaped massage apparatus, according to an embodiment of this invention.

As shown in FIG. 3, the hand holdable hoop 20 closes back upon itself to define an enclosed area 35. The enclosed area includes an enclosed height and an enclosed width. As shown in FIG. 1, the enclosed area of the hand holdable hoop is preferably sufficient to allow the hoop to encircle a torso 40 or a trunk of a person as typified by that of the user 25. The enclosed height and the enclosed width of the hand holdable hoop are also preferably sized to be greater than the width of the shoulders and hips of the user. Additionally the enclosed height and the enclosed width of the hand holdable hoop are also preferably adjustable to allow the hoop to encircle or surround most torsos, shoulders and hips. Alternatively, the hand holdable hoop 20 of the present invention can include sleeved or telescoping segments (not shown) to allow the user to adjust the length of the legs 32 of the hoop or alternatively to adjust the distance between the legs of the hoop as spanned by the straight upper bar 30.

As shown in FIGS. 1, 2 and 4 through 7, the bracket 15 mounts to the upper bar 30 of the hand holdable hoop 20. The bracket includes a hoop mount 52 and a massage unit clamp 54. The hoop mount of the bracket can be a simple conventional C-shaped self clamping bracket, fabricated from a resilient plastic. However, the hoop mount is preferably fabricated from a pair of saddle shaped caps 55 as shown in FIG. 7, both preferably fabricated from high density plastic.

The pair of saddle shaped caps 55 are referred to herein as a top cap 56 and a base cap 57, as shown in FIGS. 1, 2, FIGS. 4 through 7, and in the exploded detail of FIG. 7. The top cap preferably mounts to the base cap by receiving four mounting screws 60 as shown in FIG. 7. The four mounting screws are preferably received into four countersunk holes 62 within the top cap. The four countersunk holes also penetrate into the base cap, so that the pair of saddle shaped caps are firmly held together when the four mounting screws are tightened. Alternatively, any number of mounting screws could be utilized. Also alternatively, a hinged mount with a more permanent fastener could be employed, such as pop type rivets, or adhesive.

Figure 2:
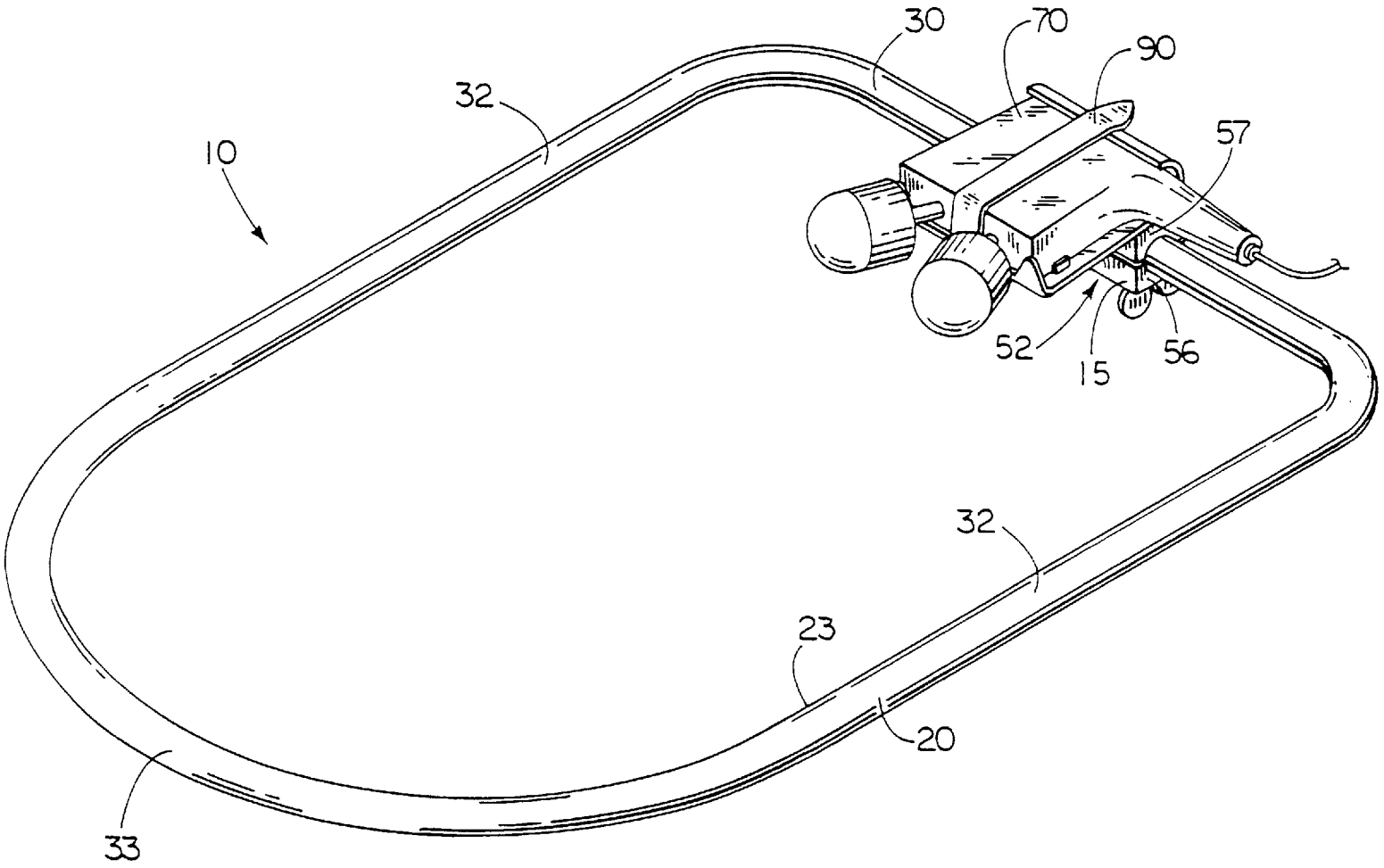
FIG. 2 is a perspective diagram of a hoop shaped massage apparatus, according to an embodiment of this invention.

FIGS. 1 and 2 of the present invention show that the top cap and the base cap together form a cylindrical annular space 65 for receiving the upper bar 30 of the hand holdable hoop 20. The hoop mount of the bracket firmly encloses the hand holdable hoop. Preferably, the hoop mount can rotate upon the upper bar of the hoop, to allow reorientation of the massage unit relative to the torso of the user.

The massage unit clamp 54 of the bracket 15 is configured to accept a massage unit 70. The massage unit is preferably a vibrating massage unit of conventional design. Alternatively, the massage unit clamp can receive a heat producing massage unit, with or without vibrating massage.

In the most preferred embodiment of the present invention, the massage unit clamp 54 is configured as shown in FIG. 7. The massage unit clamp preferably includes a rigid piece of thin material 75 that is bent or formed into a U-shape, to receivably fit over the outer casing 80 of the massage unit 70. The rigid piece of thin material can be attached to the hoop mount 52 of the bracket 15 with mounting screws 85 as shown in FIG. 7 or alternatively by an adhesive attachment.

As detailed in FIG. 7, the massage unit 70 is removably receivable into the massage unit clamp 54 of the bracket 15 and preferably held within the U-shaped rigid piece of thin material 75 by a length of strap 90 having a loop and hook connection 95, more specifically known as a product sold under the trademark "VELCRO". Additionally, several nubs, points or tabs 100, as also shown in FIG. 7, can be included in the interior surface of the rigid piece of thin material to prevent the massage unit from slipping or moving within the massage unit clamp.

Also alternatively, a donut shaped massaging element (not shown), with optional nubs or ribs (not shown), could be removably inserted upon the straight upper bar of the hand holdable hoop 20. The straight upper bar can thread through the center hole of the donut shaped element, thereby allowing the donut shaped element to rotate on the straight upper bar as the hand holdable hoop is moved up and down the body of the user 25. For magnet therapy, the donut shaped element could also include magnets or magnetized sub-elements.

An additional alternative embodiment comprises the attachment of a lotion or medication dispenser (not shown) to the hoop shaped element 20. The dispenser or application could be used alone or in conjunction to the massage unit 70, or with the donut shaped massaging element (not shown)

In another alternative embodiment of the present invention, a non-massage device, such as a hair dryer or hot comb could attach to the bracket 15 instead of the massage unit 70. A non-massage device such as the hair dryer would be a convenient attachment to the hand holdable hoop 20, especially for disabled persons with limited range of arm motion or body movement.

The method of the present invention includes mounting the massage unit 70 to the hand holdable hoop 20 as a first step. This mounting is preferably achieved by mounting a bracket 15 to the hand holdable hoop and removably attaching the massage unit to the bracket. Most preferably, the manufacturer of the hand holdable hoop includes the bracket in the manufactured product. The user 25 may then attach a massage unit to the massage unit clamp 54 of the bracket. The massage unit may be any typical massage unit that is commercially available and approximately sized to be receivable into the massage unit clamp.

In a more preferred method of the present invention, prior to positioning the hand holdable hoop 20 of the massage apparatus 10 for use, the user 20 may adjust the hand holdable hoop to encircle their torso 40, trunk or shoulders. The hand holdable hoop is adjustable to allow users of varying body sizes and types to use the present invention. Other areas of the user's body, besides the torso, trunk or shoulders, are additionally considered for encirclement by the hand holdable hoop. The head, the legs, arms and feet of the user can also be massaged with the hoop shaped massage apparatus. Any of these areas of the user's body are referred to herein as the selected body area.

The user 25 can utilize the hand holdable hoop 20 for leverage in applying a force or pressure upon the selected body area with the massage unit 70. The user, upon positioning the hand holdable hoop around the selected body area, such as the torso 40 as shown in FIG. 1, can apply pressure upon the massage unit by pulling on the legs 32 of the hand holdable hoop 20 in a direction away from the massage unit, the massage unit being attached to the upper bar. Alternatively, the user can push the U-shaped lower bar in a direction away from the massage unit attached to the straight upper bar of the hand holdable hoop. With the hand holdable hoop, the user can, for example, guide the attached massage device along their torso, moving it up and down their spine from the base of the neck to the small of the back, applying pressure by pushing outward, upon the U-shaped lower bar, again in a direction away from the attached massage unit.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. A massage apparatus comprising:

a hand holdable hoop, the hand holdable hoop having an enclosed area, the enclosed area including an enclosed width and an enclosed height, the enclosed area greater than an area sufficient to encircle a selected body area, a bracket mounted to said hand holdable hoop, the bracket including a saddle shaped mount and a massage unit mount, the saddle shaped mount having an annular space for receiving said hand holdable hoop; and a massage unit received into said massage unit mount, the massage unit is removably attached to said bracket, the massage unit comprises a vibrating massage unit of a conventional design.

2. The massage apparatus of claim 1, wherein said massage unit comprises a heat massage unit of conventional design.

3. The massage apparatus of claim 1, wherein the annular space of the saddle shaped mount is a cylindrical annular space.

4. The massage apparatus of claim 1, wherein the mount of said bracket to said hand holdable hoop is a rotatable mount.

* * * * *